US006416378B2

(12) United States Patent
Yurkoski

(10) Patent No.: US 6,416,378 B2
(45) Date of Patent: Jul. 9, 2002

(54) METHOD OF SETTING A BOOMERANG TOY IN MOTION

(76) Inventor: Rikkie Francis Yurkoski, 5232-57 Street, Beaumont, Alberta, T4X 1B3 (CA)

( * ) Notice: Subject to any disclaimer, the term of this patent is extended or adjusted under 35 U.S.C. 154(b) by 0 days.

(21) Appl. No.: 09/776,042

(22) Filed: Feb. 1, 2001

Related U.S. Application Data

(63) Continuation-in-part of application No. 09/359,951, filed on Jul. 22, 1999, now abandoned.

(51) Int. Cl.[7] ..... A63H 27/00
(52) U.S. Cl. ..... 446/34; 446/61
(58) Field of Search ..... 446/34, 61, 62, 446/64, 67, 36, 46, 48; 273/340, 129 R, 353, 317; 473/590

(56) References Cited

U.S. PATENT DOCUMENTS

| | | | |
|---|---|---|---|
| 477,747 | A | 6/1892 | Emerson |
| 510,936 | A | 12/1893 | Renear |
| 930,711 | A | 8/1909 | Wohlmeyer |
| 2,244,342 | A | 6/1941 | Mahlck |
| 2,298,425 | A | 10/1942 | Shaffer |
| 4,238,906 | A | 12/1980 | Bradford |
| 4,261,135 | A | 4/1981 | Lehman |
| 4,337,950 | A | 7/1982 | Gidge |
| 4,453,338 | A | 6/1984 | Lehman |
| 5,413,354 | A | 5/1995 | Miller |
| 5,465,976 | A | 11/1995 | Gonzalez |
| 5,845,908 | A | 12/1998 | Reichardt |

FOREIGN PATENT DOCUMENTS

| | | |
|---|---|---|
| CA | 712326 | 6/1965 |
| CA | 735649 | 6/1966 |
| CA | 1213920 | 11/1986 |
| CA | 1306478 | 8/1992 |

OTHER PUBLICATIONS

Abstract of Canadian Patent No. 1,215,729, Marshall R. Blight, Dec. 23, 1986, 1 page, with 4 pages of drawings.
Abstract of U.S. Patent No. 3,814,431, Paul J. Callahan, Jun. 4, 1974, 2 pages.
Abstract of U.S. Patent No. 4,238,906, Joseph Bradford, Sr., Dec. 16, 1980, 2 pages.
Abstract of U.S. Patent No. 4,372,281, Franco Fiorani, Feb. 8, 1983, 2 pages, with cover page of patent and two disclosure pages of patent.
Abstract of U.S. Patent No. 4,541,637, Afkielski, Sep. 17, 1985, 1 page.
Abstract of U.S. Patent No. 4,722,532, William J. Harris, Feb. 2, 1988, 2 pages, with cover page of patent.
Abstract of U.S. Patent No. 4,856,793, Matt B. Hannifin, Aug. 15, 1989, 2 pages.
Abstract of U.S. Design Patent No. 389,878, Joseph C. Tylor, Jan. 27, 1998, 1 page, with coverpage of design patent.

*Primary Examiner*—Jacob K. Ackun
*Assistant Examiner*—Faye Francis
(74) *Attorney, Agent, or Firm*—Christensen O'Connor Johnson Kindness PLLC

(57) ABSTRACT

A method of setting a boomerang toy in motion. A first step involves providing a boomerang toy which has insufficient mass to be thrown in a conventional manner. The boomerang toy has a substantially planar generally "V" shaped body with an apex and two arm portions. The arm portions have an aerodynamic curvature. The body of the boomerang toy has an inner edge and an outer edge. A second step involves supporting the body solely by pinching the apex of the body between a finger and a thumb of a first hand of a user and orienting the body at a slightly upwardly angle in preparation for flight. A third step involves striking one of the arm portions of the body along the inner edge with an extended finger of a second hand of the user to initiate flight.

1 Claim, 3 Drawing Sheets

FIG. 1
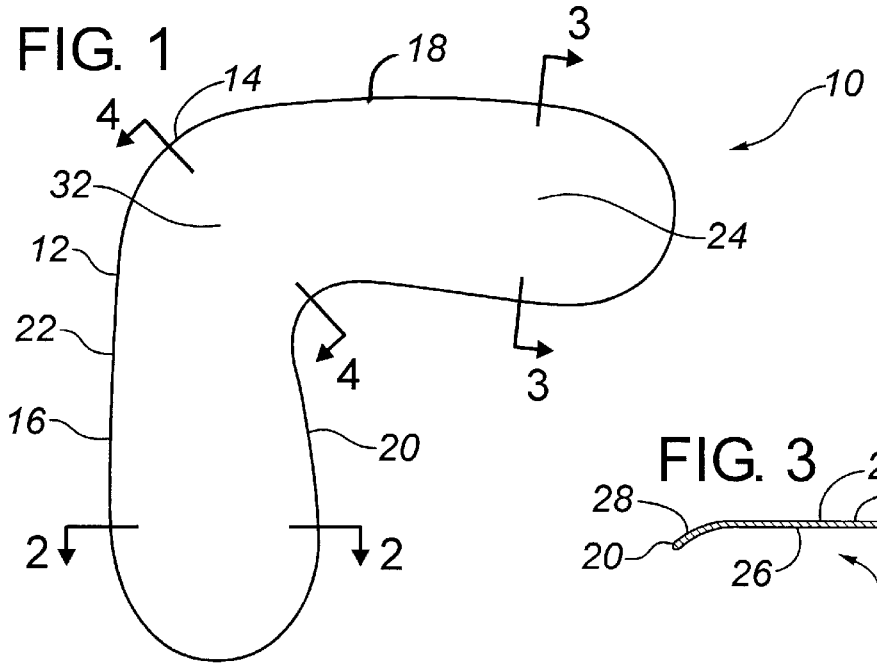
FIG. 3
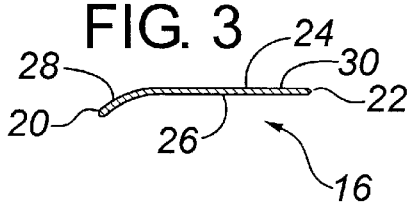
FIG. 4
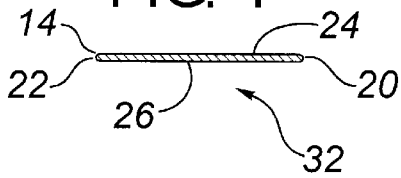
FIG. 2
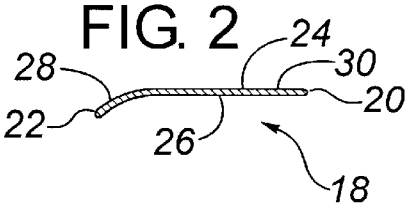
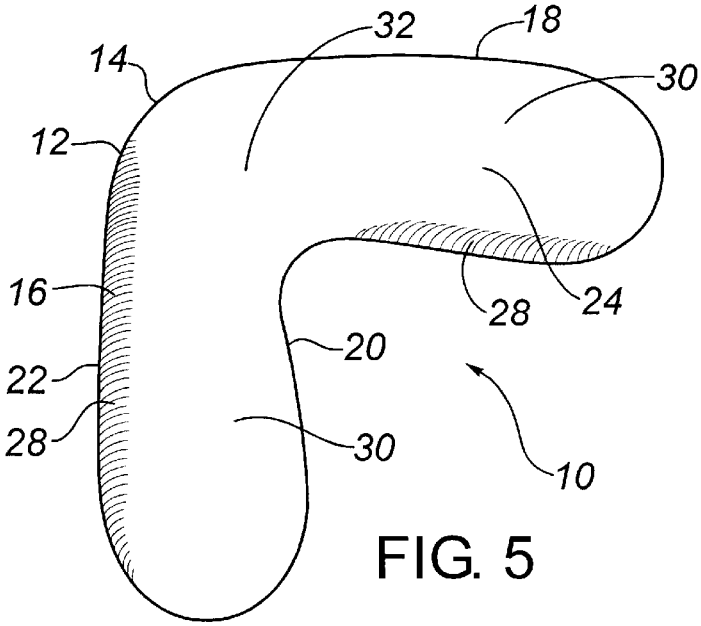
FIG. 5

METHOD OF SETTING A BOOMERANG TOY IN MOTION

CROSS-REFERENCE TO RELATED APPLICATION

The present application is a continuation-in-part of U.S. patent application Ser. No. 09/359,951, filed Jul. 22, 1999 (now abandonment).

BACKGROUND OF THE INVENTION

A boomerang is a generally "V" shaped missile used by Australian aboriginals to kill prey. The most notable feature about a boomerang is that it is able to return in flight to the thrower. It is this ability to return in flight to the thrower that makes a boomerang suitable for use as a toy.

The original boomerang was made from hardwood. Such a boomerang is capable of injuring any person unfortunate enough to be struck. Boomerang toys are, therefore, generally made out of materials that will not inflict serious injury upon a person who is struck.

Although they will not inflict serious injury upon persons, boomerang toys thrown in the traditional manner are still capable of knocking over lamps, vases and other household objects. For this reason, it is recommended that they be used out of doors.

It is possible to make a miniature boomerang toy which is completely safe for indoor use made out of light plastic or paper laminated by one or more layers of plastic. These boomerang toys have insufficient mass to knock over objects, but they also have insufficient mass to be thrown in a conventional manner. When thrown, the boomerang toys merely flutter to the ground.

SUMMARY OF THE INVENTION

What is required is a method of setting such a boomerang toy in motion.

According to the present invention there is provided a method of setting a boomerang toy in motion. A first step involves providing a boomerang toy which has insufficient mass to be thrown in a conventional manner. The boomerang toy has a substantially planar generally "V" shaped body with an apex and two arm portions. The arm portions have an aerodynamic curvature. The body of the boomerang toy has an inner edge and an outer edge. A second step involves supporting the body solely by pinching the apex of the body between a finger and a thumb of a first hand of a user and orienting the body at a slightly upwardly angle in preparation for flight. A third step involves striking one of the arm portions of the body along the inner edge with an extended finger of a second hand of the user to initiate flight.

Using the method, as described above, a boomerang toy having insufficient mass to be thrown, can be launched and perform sufficiently to amuse a child.

BRIEF DESCRIPTION OF THE DRAWINGS

These and other features of the invention will become more apparent from the following description in which reference is made to the appended drawings, wherein:

FIG. 1 is a perspective view of a toy boomerang constructed in accordance with the teachings of the present invention.

FIG. 2 is a section view of the toy boomerang illustrated in FIG. 1, taken along section lines 2—2 of FIG. 1.

FIG. 3 is a section view of the toy boomerang illustrated in FIG. 1, taken along section lines 3—3 of FIG. 1.

FIG. 4 is a section view of the toy boomerang illustrated in FIG. 1, taken along section lines 4—4 of FIG. 1.

FIG. 5 is a perspective view illustrating a preferred method of initiating flight of the toy boomerang illustrated in FIG. 1.

DETAILED DESCRIPTION OF THE PREFERRED EMBODIMENT

Figure 6:
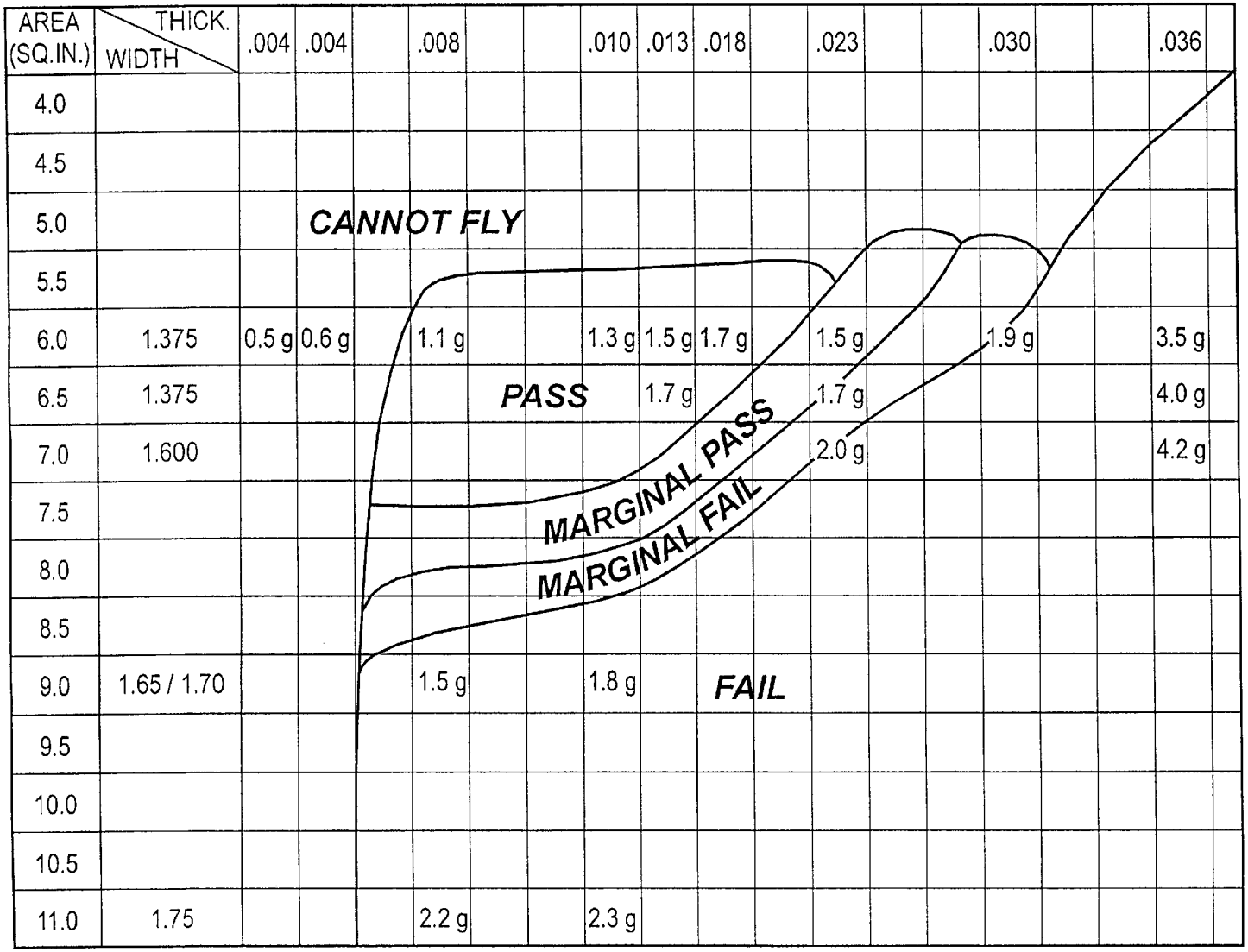
FIG. 6 is a graph relating to the inter-relationship of surface area, width, thickness and weight in the construction of a toy boomerang in accordance with the teachings of the present invention.
Figure 7:
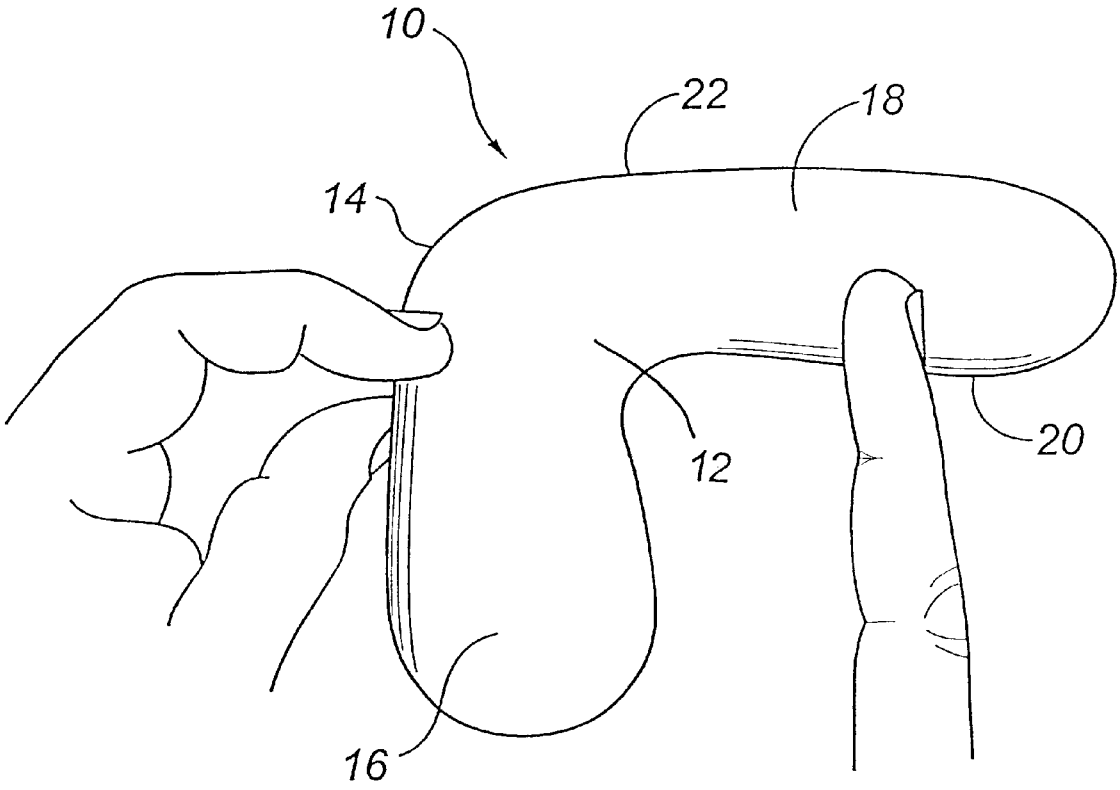
FIG. 7 is a perspective view of the boomerang toy illustrated in FIG. 1 in the process of being launched.

The preferred embodiment, a toy boomerang generally identified by reference numeral 10, will now be described with reference to FIGS. 1 through 7.

Referring to FIG. 1, boomerang toy 10 comprises a substantially planar generally "V" shaped body 12 having an apex 14, a first arm portion 16 and a second arm portion 18. Body 12 has an inner edge 20 and an outer edge 22. Referring to FIGS. 2 through 4, body 12 has a substantially uniform thickness. Body 12 has a top surface 24 and a bottom surface 26. Body 12 is constructed of a light weight and substantially rigid material. Material of which body 12 is constructed can be cardboard or stiff paper or porous plastic or like material. Beneficial results have been obtained through the use of a paper stiffened with laminated plastic. Top surface 24, bottom surface 26, inner edge 20 and outer edge 22 of body 12 can be laminated with a thin coating of a water and wear resistant material such as a plastic to enhance the durability of boomerang toy 10.

Referring to FIG. 6, there is provided a graph that shows the inter-relationship of surface area, width, thickness and weight. Body 12 constructed as described above has a weight that is so light that body 12 will not return in flight when said body 12 is grasped by one of first arm portion 16 and second arm portion 18 and is thrown, but instead will flutter to the ground. A special technique is required for initiating flight of boomerang toy 10, as will hereinafter be further described. Referring to FIG. 6, this graph was produced by testing boomerang toys with differing flight characteristics. The boomerang toys were deliberately flown from a distance of 18 inches into an object representing a cylindrical object representing a glass containing liquid that was 5 inches tall, two inches in diameter and had a weight of 35 grams. The graph discloses a number of zones, including a pass zone, a marginal pass zone, a marginal fail zone, a don't fly zone and a fail zone. All boomerangs in the pass zone had good flight characteristics and yet did not knock over the cylindrical test object. The marginal pass zone and the marginal fail zone produce boomerang toys with good flight characteristics, but they caused movement of the cylindrical test object upon striking that fell short of knocking it over. Extensions F—F separate the don't fly zone from the fail zone. All boomerang toys in the don't fly zone were either too flimsy to fly or had an insufficient wing surface area to weight ratio that effectively negated the desired boomerang flight. All boomerang toys in the fail zone could fly, but generated enough forward momentum to knock over the cylindrical test object. Based upon this analysis certain parameters can be extrapolated. The weight of the boomerang toy should be not less than 0.800 grams and not more than 1.80 grams. The thickness of the boomerang toy should be not less than 0.008 of an inch and not more than 0.030 on an inch. The wing surface area of the boomerang toy should be not less than 5.5 square inches and not more than 8.0 square inches. It must be noted, however, that a boomerang toy with a maximum recommended surface area of 8.0 square inches and a maximum recommended weight of 1.80 grams was able to generate enough momentum to knock over the cylindrical test object. In order to ensure compliance throughout the ranges a wing surface area to weight ratio of approximately 6 to 1 is preferred. Of course, if one is not concerned about knocking over objects, the operative range can be dramatically broadened.

Referring to FIGS. 2 and 3, first arm portion 16 and second arm portion 18 both have an aerodynamic curvature. The aerodynamic curvature of each of first arm portion 16 and second arm portion 18 includes a downwardly curved section 28 and a substantially planar section 30. The positioning of downwardly curved section 28 and substantially planar section 30 for each of first arm portion 16 and second arm portion 18 will now be described for boomerang toy 10 that is to be held in the left hand and propelled by striking with a finger of the right hand of a user. Referring to FIG. 2, downwardly curved section 28 is at outer edge 22 and substantially planar section 30 is at inner edge 20 of first arm portion 18 of body 12. Referring to FIG. 3, downwardly curved section 28 is at inner edge 20 and substantially planar section 30 is at outer edge 22 of second arm portion 18 of body 12. Referring to FIG. 4, a central section 32 of body 12 is substantially planar between apex 14 at outer edge 22 and inner edge 20.

The preferred method of use of boomerang toy 10 will now be described with reference to FIGS. 1 through 7. Boomerang toy 10, as illustrated in FIG. 5, is provided. Apex 14 of body 12 is pinched between a finger and a thumb of the left hand of a user. Second arm section 18 extends outwardly away from the user's hand. Body 12 is oriented at a slightly upward angle away from the user's body in preparation for flight. The outwardly extending second arm portion 18 is struck sharply along inner edge 20 with an extended finger of the user's right hand in a direction away from the user's body to initiate flight.

It will be recognized that a boomerang toy 10 constructed as a mirror image of boomerang toy 10 illustrated in FIG. 5 preferably is used by pinching apex 14 between the thumb and a finger of the user's right hand, and striking the inner edge 20 of the outwardly extending first arm portion 16 with an extended finger of the user's left hand.

It will also be recognized that the method of initiating flight of the boomerang toy, as described, is not suitable for use in setting a conventional aboriginal boomerang in motion.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of setting a toy boomerang in motion, comprising the steps of:

providing a boomerang toy which has a weight of not more than 1.80 grams, thereby having insufficient mass to be thrown in a conventional manner, the boomerang toy having a substantially planar "V" shaped body with an apex and two arm portions, the arm portions having an curvature for flight, the body of the boomerang toy having an inner edge and an outer edge;

pinching the body solely at the apex of the body between a finger and a thumb of a first hand of a user and orienting the body at a slightly upwardly angle in preparation for flight; and striking one of the arm portions of the body along the inner edge with an extended finger of a second hand of the user to initiate flight.

* * * * *

UNITED STATES PATENT AND TRADEMARK OFFICE

CERTIFICATE OF CORRECTION

PATENT NO. : 6,416,378 B2
DATED : July 9, 2002
INVENTOR(S) : R.F. Yurkoski

It is certified that error appears in the above-identified patent and that said Letters Patent is hereby corrected as shown below:

Column 4,
Line 27, “an curvature” should read -- a curvature --; and
Line 27, “for flight,” should read -- for aerodynamic flight, --

Signed and Sealed this

Twenty-fourth Day of December, 2002

JAMES E. ROGAN
*Director of the United States Patent and Trademark Office*